US006920986B2

(12) United States Patent
Lacombe et al.

(10) Patent No.: US 6,920,986 B2
(45) Date of Patent: Jul. 26, 2005

(54) TOOL HOLDER ASSEMBLY

(75) Inventors: Michel Lacombe, Saint-Jean-Port-Joli (CA); Emmanuel Guay, Cap-Saint-Ignace (CA); Francis Leblanc, Saint-Pamphile (CA)

(73) Assignee: Rousseau Metal Inc., Quebec (CA)

( * ) Notice: Subject to any disclaimer, the term of this patent is extended or adjusted under 35 U.S.C. 154(b) by 0 days.

(21) Appl. No.: 10/348,016

(22) Filed: Jan. 22, 2003

(65) Prior Publication Data

US 2003/0222036 A1 Dec. 4, 2003

(30) Foreign Application Priority Data

May 28, 2002 (CA) ..... 2387483

(51) Int. Cl.[7] ..... A47F 7/00
(52) U.S. Cl. ..... 211/70.6
(58) Field of Search ..... 211/70.6, 94.01, 211/71.01, 126.1, 126.16, 133.1, 133.6, 60.1; 206/349, 372, 557, 560, 562

(56) References Cited

U.S. PATENT DOCUMENTS

| | | | | |
|---|---|---|---|---|
| 1,273,622 A | | 7/1918 | Kollman | |
| 1,341,848 A | | 6/1920 | Haensler | |
| 2,841,114 A | | 7/1958 | Grant | 119/51 |
| 2,896,829 A | | 7/1959 | Bright | 224/48 |
| D196,665 S | | 10/1963 | Barnett | D44/10 |
| D201,695 S | | 7/1965 | Bieger | D44/10 |
| 3,604,565 A | | 9/1971 | Freeman | 211/60 T |
| 4,117,937 A | | 10/1978 | Ratti | 211/60 T |
| 4,155,460 A | | 5/1979 | Ratti | 211/60 T |
| D255,752 S | | 7/1980 | Källström | D7/71 |
| 4,253,830 A | | 3/1981 | Kazen et al. | 433/77 |
| 4,359,163 A | | 11/1982 | Ratti | 211/60 T |
| 4,509,649 A | | 4/1985 | Evans | 211/70.6 |
| 4,535,897 A | | 8/1985 | Remington et al. | 211/70.6 |
| 5,050,756 A | | 9/1991 | Tielker et al. | 220/23.4 |
| 5,083,664 A | * | 1/1992 | Feng | 206/372 |
| 5,617,960 A | * | 4/1997 | Bishop | 211/60.1 |
| 5,632,388 A | | 5/1997 | Morrison et al. | 211/74 |
| D446,611 S | | 8/2001 | Gunter | D30/130 |
| 6,571,966 B1 | * | 6/2003 | Hsiao | 211/70.6 |

FOREIGN PATENT DOCUMENTS

| | | |
|---|---|---|
| DE | 3931062 | 3/1991 |
| FR | 2731938 | 9/1996 |

* cited by examiner

*Primary Examiner*—Jennifer E. Novosad
(74) *Attorney, Agent, or Firm*—McDermott Will & Emery LLP

(57) ABSTRACT

A tool holder assembly comprising two opposite end members spaced from each other. Two opposite rail members extend between the end members and are spaced from each other. A tool support arrangement is mountable between the rail members. The tool support arrangement has two opposite tracks spaced from each other, and upper and lower plates extending one above the other at different heights between the tracks. At least one of the plates is removably mounted between the tracks. The plates are adapted to have respective alignable holes for bi-level tool support. A mounting arrangement is provided for mounting the tool support arrangement between the rail members.

26 Claims, 6 Drawing Sheets

10
16
20
42
38
30
14
22
12
28
18
46
82
8
36
40
4
78
88
84
6
44
80
2
76

38
10'
36
8
4
6
2

TOOL HOLDER ASSEMBLY

FIELD OF THE INVENTION

The present invention relates to a tool holder assembly, and more particularly to a tool holder assembly especially adapted for numerical control machine tools.

BACKGROUND

Users of numerical control machine tools need storage for the unused tools.

A basic tool storage system may consist of a simple perforated steel plate provided with plastic rings around the perforations to protect the tools and prevent them from being damaged.

Known in the art are U.S. Pat. No. 1,341,848 (Haensler), U.S. Pat. No. 3,604,565 (Freeman), U.S. Pat. No. 4,117,937 (Ratti), U.S. Pat. No. 4,155,460 (Ratti), U.S. Pat. No. 4,359,163 (Ratti), U.S. Pat. No. 4,509,649 (Evans), U.S. Pat. No. 4,535,897 (Remington et al.), and FR patent application No. 2,731,938 (Renard), which show various models of holders for such type of tools.

The system of Remington et al. consists of an aluminum extrusion which can be broken into individual modules or be left unbroken to accommodate several tools at once. Again, plastic rings are added around the perforations to protect the tools. The tools are supported over two levels for more stability and to prevent them from falling down when the holder is set at an angle. As the height of the tools is variable, it is necessary to provide different extrusions for varying the distance between the two levels. It is relatively difficult to drill holes in this system because each module is in one piece and the diameters of both holes are different.

The system of Ratti may use injected plastic modules. The system is efficient but requires many models of modules for accommodating the various models of tools. Consequently, this system is relatively expensive and requires important investments for the making of the moulds. The transport handles are often made of steel wires. Since a loaded tool holder may be very heavy, the handles become uncomfortable.

Also of interest are U.S Pat No. Des. 196,665 (Barnett), Des. 201,695 (Bieger), Des. 255,752 (Källström), D446,611 (Gunter), U.S. Pat. No. 1,273,622 (Kollman), U.S. Pat. No. 2,841,114 (Grant), U.S. Pat. No. 2,896,829 (Bright), U.S. Pat. No. 4,253,830 (Kazen et al.), U.S. Pat. No. 5,050,756 (Tielker et al.), U.S. Pat. No. 5,632,388 (Morrison et al.), and DE patent No. 39 31 062 (Bloksma), which illustrate the state of the art.

SUMMARY

An object of the present invention is to provide a tool holder assembly which is highly versatile and which practically accommodates all the types of tools such as used in numerical control machines.

Another object of the present invention is to provide such a tool holder assembly which is easy to make, which has a low manufacturing cost, and which can even be designed to be adapted by the user.

According to the present invention, there is provided a tool holder assembly comprising two opposite end members spaced from each other, two opposite rail members extending between the end members and spaced from each other, a tool support arrangement mountable between the rail members, and means for mounting the tool support arrangement between the rail members. The tool support arrangement has two opposite tracks spaced from each other, and upper and lower plates extending one above the other at different heights between the tracks. At least one of the plates is removably mounted between the tracks. The plates are adapted to have respective substantially alignable holes for bi-level tool support.

BRIEF DESCRIPTION OF THE DRAWINGS

A detailed description of preferred embodiments will be given herein below with reference to the following drawings, in which like numbers refer to like elements.

DETAILED DESCRIPTION OF THE PREFERRED EMBODIMENTS

Figure 1:
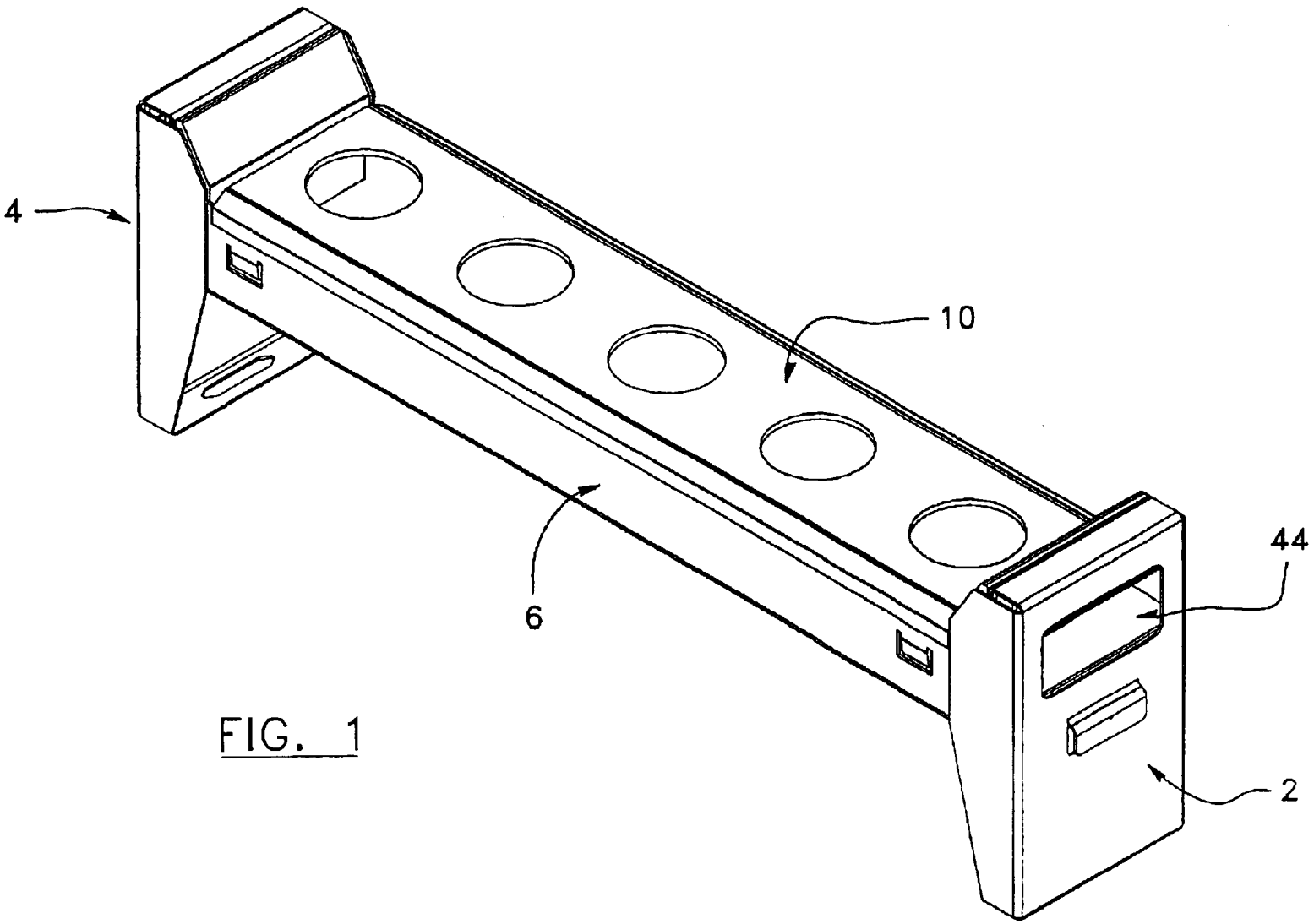
FIG. 1 is a perspective view of a tool holder assembly according to the present invention.

Referring to FIG. 1, there is shown a tool holder assembly according to the present invention. The tool holder assembly is particularly designed for holding tools (not shown in the Figures) such as used in numerical control machines. It can of course be used to store and hold other kinds of tools if desired.

Figure 2:
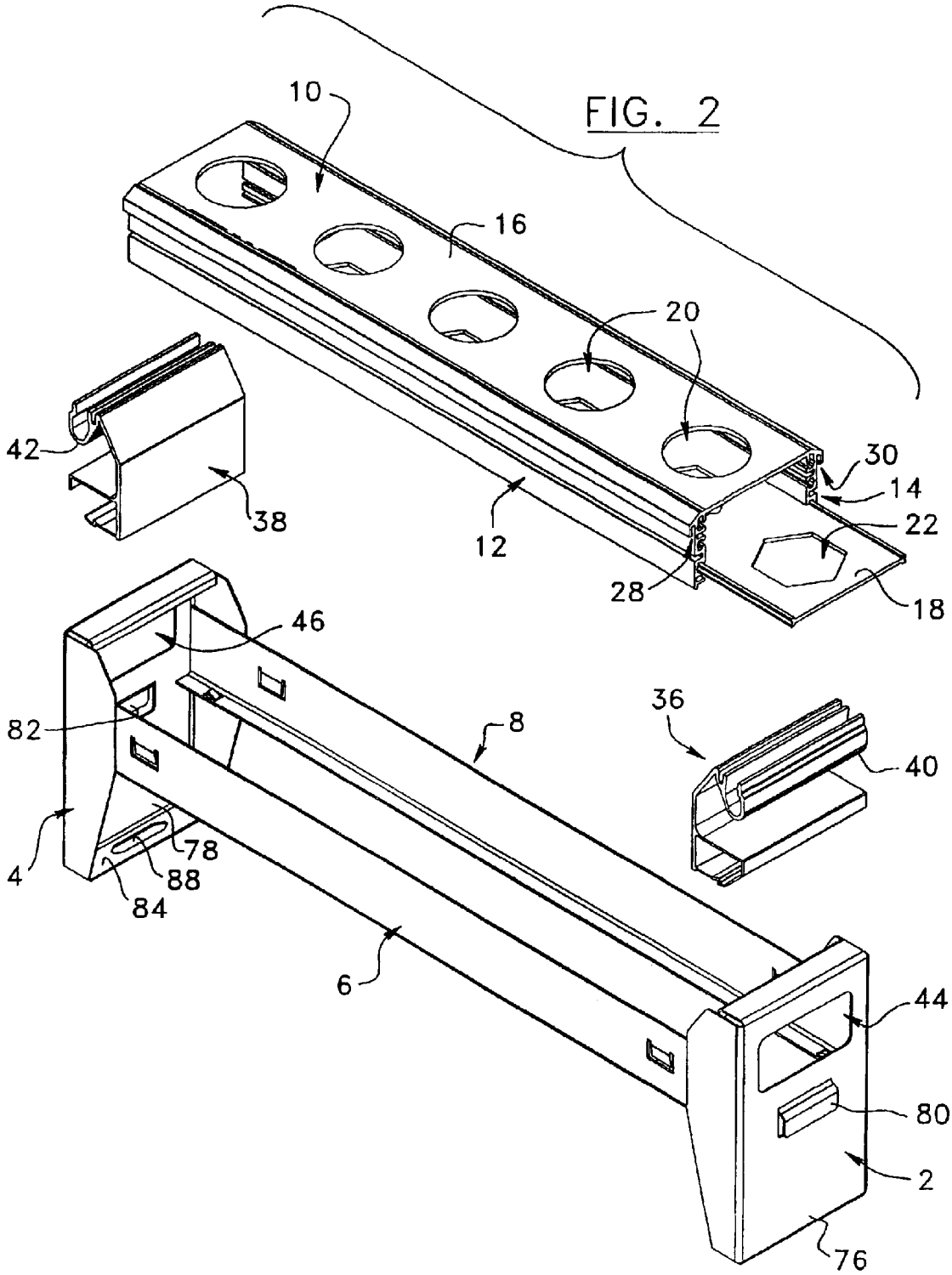
FIG. 2 is an exploded view of a tool holder assembly according to the present invention.

Referring to FIG. 2, the tool holder assembly has two opposite end members 2, 4 spaced from each other. Two opposite rail members 6, 8 extend between the end members 2, 4 and are spaced from each other. The end members 2, 4 and the rail members 6, 8 can be made of steel and welded together to form a unitary frame. They can be made of other materials, e.g. plastic, aluminum, etc., and can be detachably assembled instead of being permanently assembled together.

The tool holder assembly is provided with a tool support arrangement 10 mountable between the rail members 6, 8.

The tool support arrangement 10 has two opposite tracks 12, 14 spaced from each other, and upper and lower plates 16, 18 extending one above the other at different heights between the tracks 12, 14. At least one of the plates 16, 18 is removably mounted between the tracks 12, 14 and can be repositioned at a different height between the tracks 12, 14. As a result, the space between the plates 16, 18 can be adapted as desired. In the illustrated case, only the lower plate 18 is removably mounted. The upper plate 16 and the tracks 12, 14 are joined together to form a unitary body. The plates 16, 18 are adapted to have respective generally alignable holes 20, 22 for bi-level tool support.

The end members 2, 4 and the rail members 6, 8 form a stand for holding the tool support arrangement 10 up and providing space under the lower plate 18. The stand may be formed differently. For example, the end members 2, 4 may be directly attached to the tracks 12, 14 with no particular rail members being used.

The plates 16, 18 may originally come with already made holes 20, 22 as shown. Optionally, they may come without any holes which will have to be made later by the user using any appropriate tool, like a drill, a punch, etc. Since at least one of the plates 16, 18 is removable, such operation is easy to achieve.

As illustrated, the holes 20 in the upper plate 16 may have a circular shape while the holes 22 in the lower plate 18 may have a polygonal or irregular shape to facilitate drainage of possible liquids sticking on the tools (not shown in the Figures). The holes 20, 22 may have any other desired shape appropriate to the tools and to the use of the holder. The diameters of the holes 20, 22 can be chosen as a function of the type of tools to be stored. The holes 20 in the upper plate 16 may have a greater size than the holes 22 in the lower plate 18. Consequently, by varying the diameters of the holes 20, 22 as well as the height of the plate 18, there is obtained a very versatile system which adapts to practically all the types of tools. As indicated above, it is easier with the invention to perforate or punch the holes 20, 22 in each plate 16, 18 since both plates 16, 18 are separated. It is even possible to provide non-perforated plates so that the user may chose its own configuration of holes according to his/her needs. By providing plates 16, 18 made of plastic, it becomes unnecessary to add plastic rings to protect the tools.

The length of the plates 16, 18 and/or of the tool support arrangement may correspond to a spacing between the end members 2, 4. In such a case, the end members hold the plates 16, 18 in place and prevent them from sliding relative to each other.

The mounting of the tool support arrangement 10 between the rail members 6, 8 can be achieved in many ways.

Figure 4A:
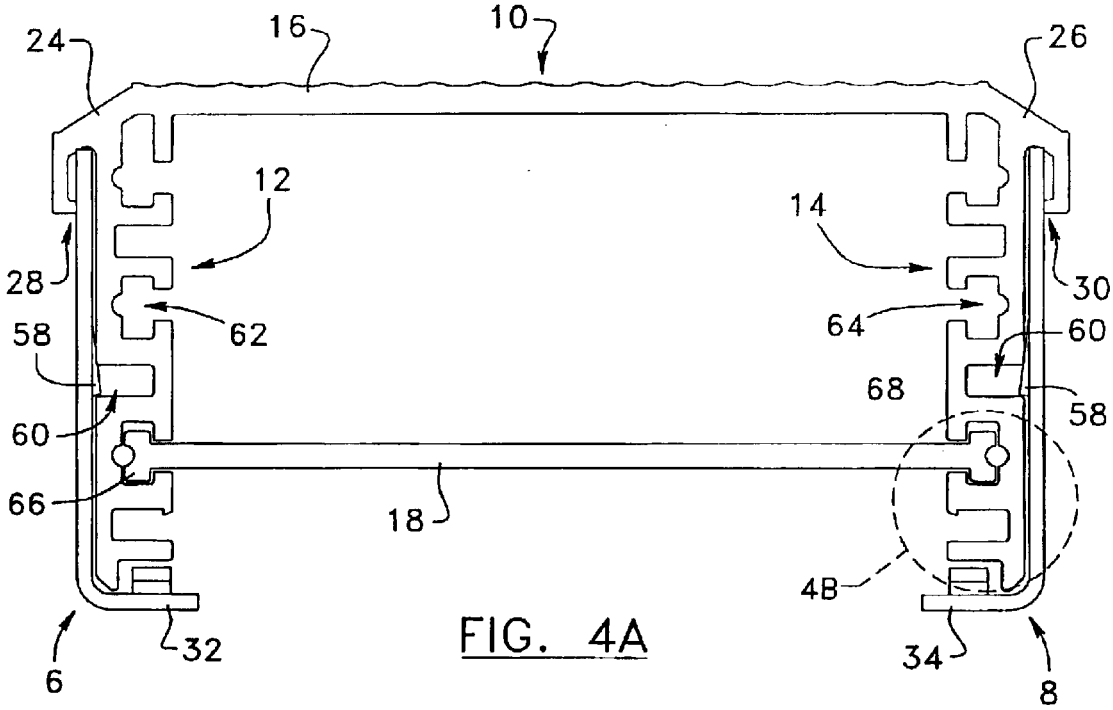
FIG. 4A is a cross-sectional view of a tool support arrangement on rail members according to the present invention.

Referring to FIG. 4A, the tool support arrangement 10 may for example be provided with opposite wings 24, 26 projecting outwards from respective sides of the tool support arrangement 10 (e.g. from both tracks 12, 14) and arranged to rest against upper edges of the rail members 6, 8 when the tool support arrangement 10 is mounted between the rail members 6, 8, as illustrated.

The wings 24, 26 may define downward slots 28, 30 (see also FIG. 2) into which the upper edges of the rail members 6, 8 respectively engage.

The rail members 6, 8 may have opposite flanges 32, 34 innerly projecting toward each other under the tracks 12, 14 of the tool support arrangement 10 and onto which the tracks 12, 14 rest when the tool support arrangement 10 is mounted between the rail members 6, 8. The flanges 32, 34 may be used for strengthening purposes without providing support for the tracks 12, 14. They may also be used for other purposes (e.g. clipping), as it will become apparent hereinafter.

Both above mounting arrangements or any other suitable mounting arrangement between the tool support arrangement 10 and the rail members 6, 8 may be used alone or in combination.

Referring back to FIG. 2, the end members 2, 4 are preferably provided with respective handle members 36, 38, which may be arranged to respectively fit in the end members 2, 4 and to provide finger gripping surfaces 40, 42 extending behind outer side openings 44, 46 in the end members 2, 4.

Figure 3B:
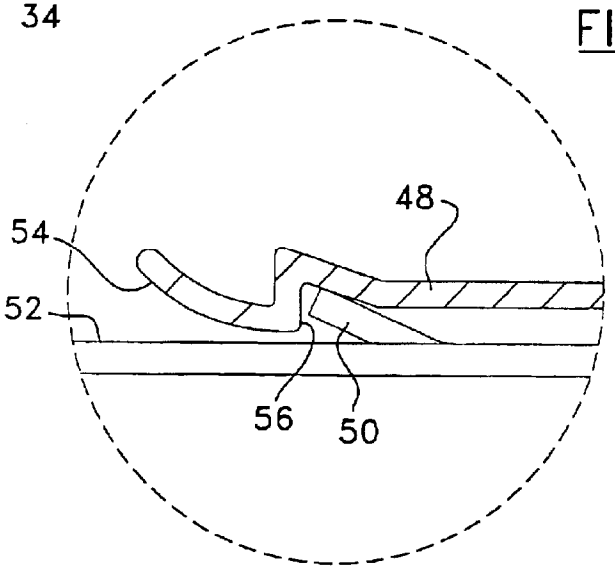
FIG. 3B is an enlarged view of a handle clipping arrangement according to the present invention.
Figure 3A:
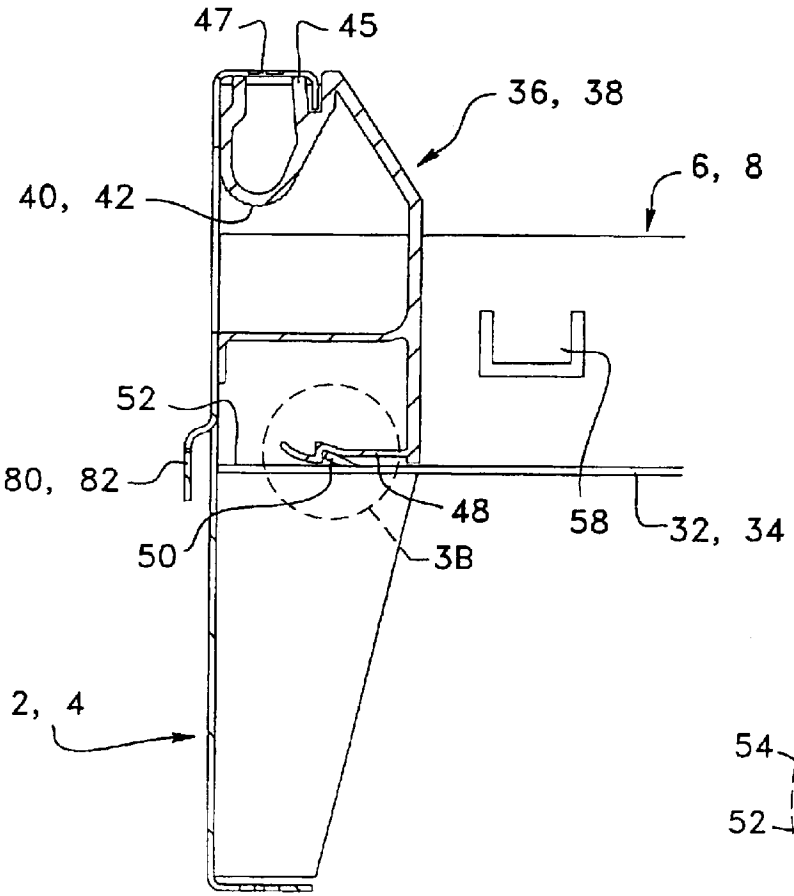
FIG. 3A is a cross-sectional view of an end member of a tool holder assembly according to the present invention.

Referring to FIG. 3A, the handle members 36, 38 may be formed of pieces (e.g. PVC extrusions or pieces made of another suitable material) which clip inside the end members 2, 4. The finger gripping surfaces 40, 42 may have a round shape. As a result, the handle members 36, 38 provide a strong yet comfortable grip.

The end members 2, 4 has upper folds 45 into which respective upper ends 47 of the handle members 36, 38 engage and are held in place. Lower bearing surfaces 52 which may conveniently be defined by the flanges 32, 34 are provided with upwardly projecting flexible tabs 50 for clipping of respective lower ends 48 of the handle members 36, 38 in the end members 2, 4.

Referring to FIG. 3B, the lower end 48 of each handle member 36, 38 (see FIGS. 2 and 3) has a flexible upwardly curved leading edge 54 followed by a notch 56 in which the flexible tab 50 engage. This configuration facilitates the clipping operation. Either one or both of the tab 50 and the leading edge 54 may be flexible.

Other handle constructions can be implemented, e.g. handles integral with the end members 2, 4 and for projecting outside the end members 2, 4 if desired, even though the above proposed construction is likely to be more practical and functional.

Figure 4B:
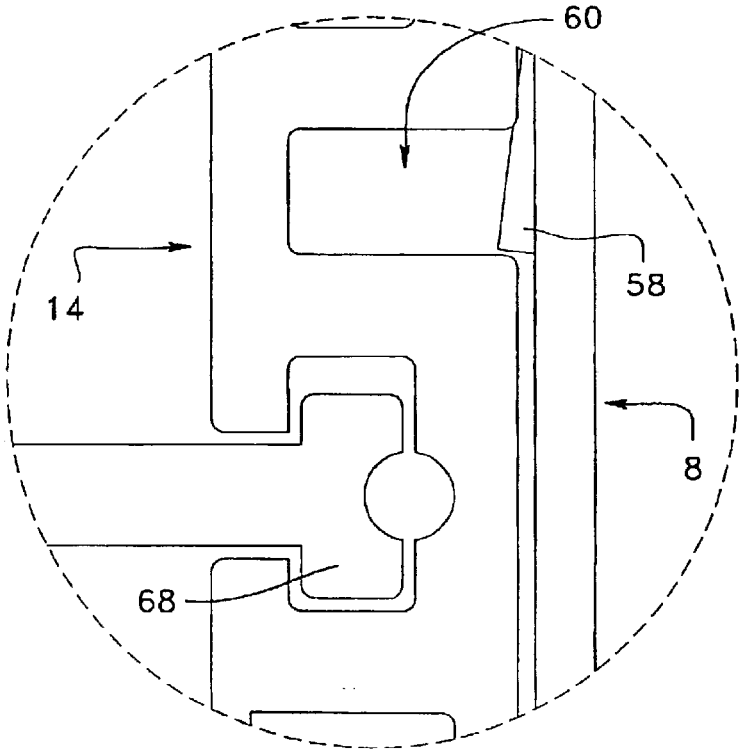
FIG. 4B is an enlarged view of a locking arrangement of a plate between the tracks of a tool support arrangement according to the present invention.

Referring to FIGS. 4A and 4B, locking tabs 58 projecting from the inner surfaces of the rail members 6, 8 and removably engaging (e.g. by clipping action) in side channels 60 extending in the outer surfaces of the tracks 12, 14 may be used to interlock the tracks 12, 14 with the rail members 6, 8 when the tool support arrangement 10 is mounted between the rail members 6, 8. The position of the locking tabs 58 and the channels 60 may be interchanged. Any other suitable locking arrangement may be used to prevent the tool support arrangement 10 from undesirably going up between the rail members 6, 8. For example, the tabs 58 could be replaced with holes in which screws or bolts (not shown in the Figures) could be inserted so as to engage in the channels 60.

The tracks 12, 14 respectively have series of aligned slots 62, 64 (three in the Figures) at different heights for slidably receiving opposite track engaging sides 66, 68 of the lower plate 18. The height of the lower plate 18 can thus be adjusted as a function of the tool to be stored. More slots 62, 64 may be provided if desired.

Figure 5:
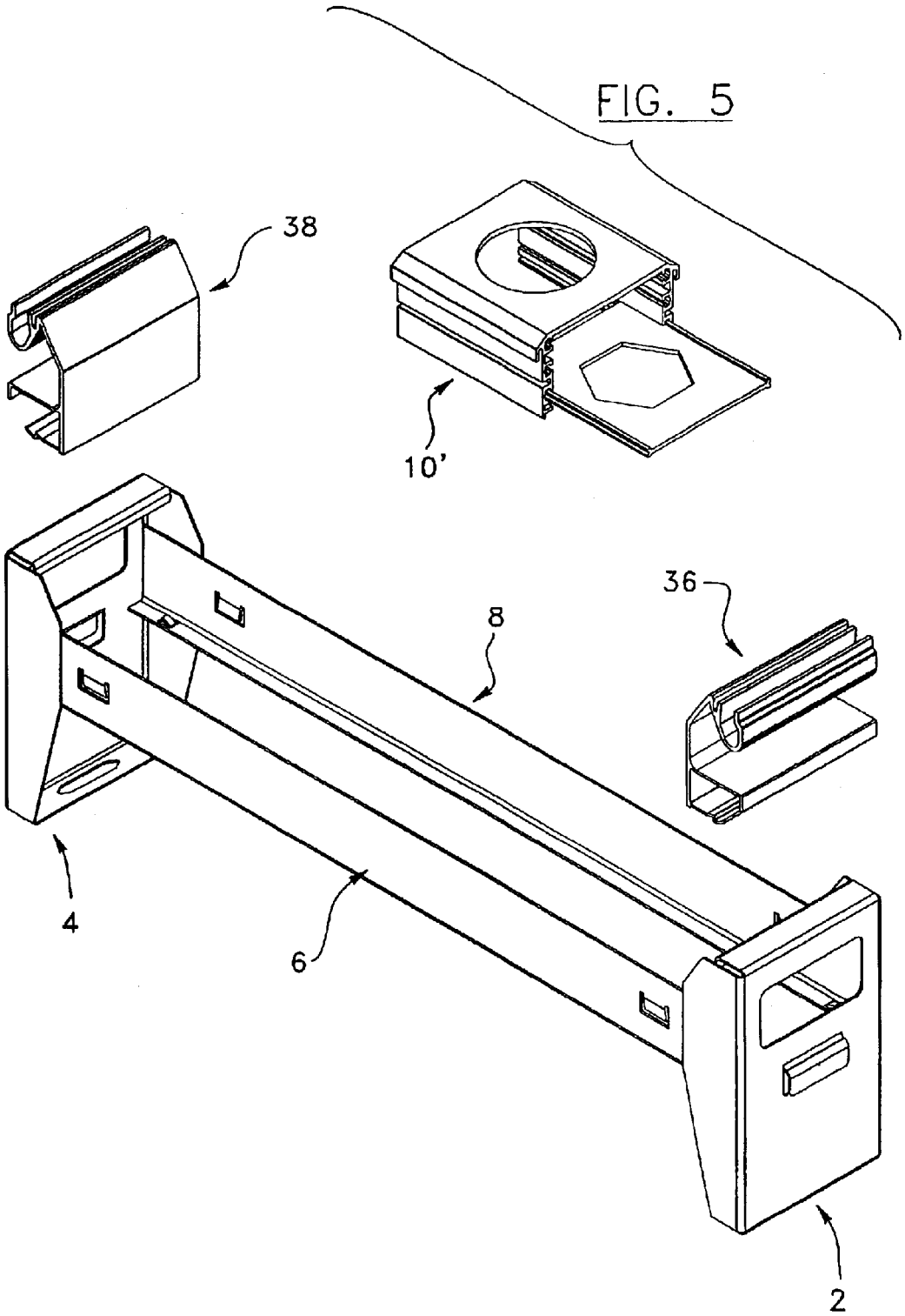
FIG. 5 is an exploded view of a tool holder assembly with an individual tool support module according to the present invention.

Referring to FIG. 5, if the user needs even more versatility and wants to store tools in the tool holder assembly which require different spaces between the two plates 16, 18, the tool support arrangement 10 may then be divided into replaceable modules 10' having a length much smaller than a spacing between the end members 2, 4. It is then possible to add or remove modules according to the needs.

Figure 6B:
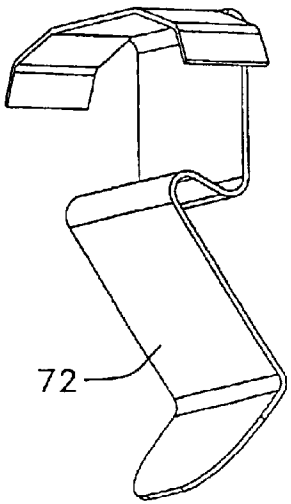
FIG. 6B is a perspective view of a clip for an individual tool support, module according to the present invention.
Figure 6A:
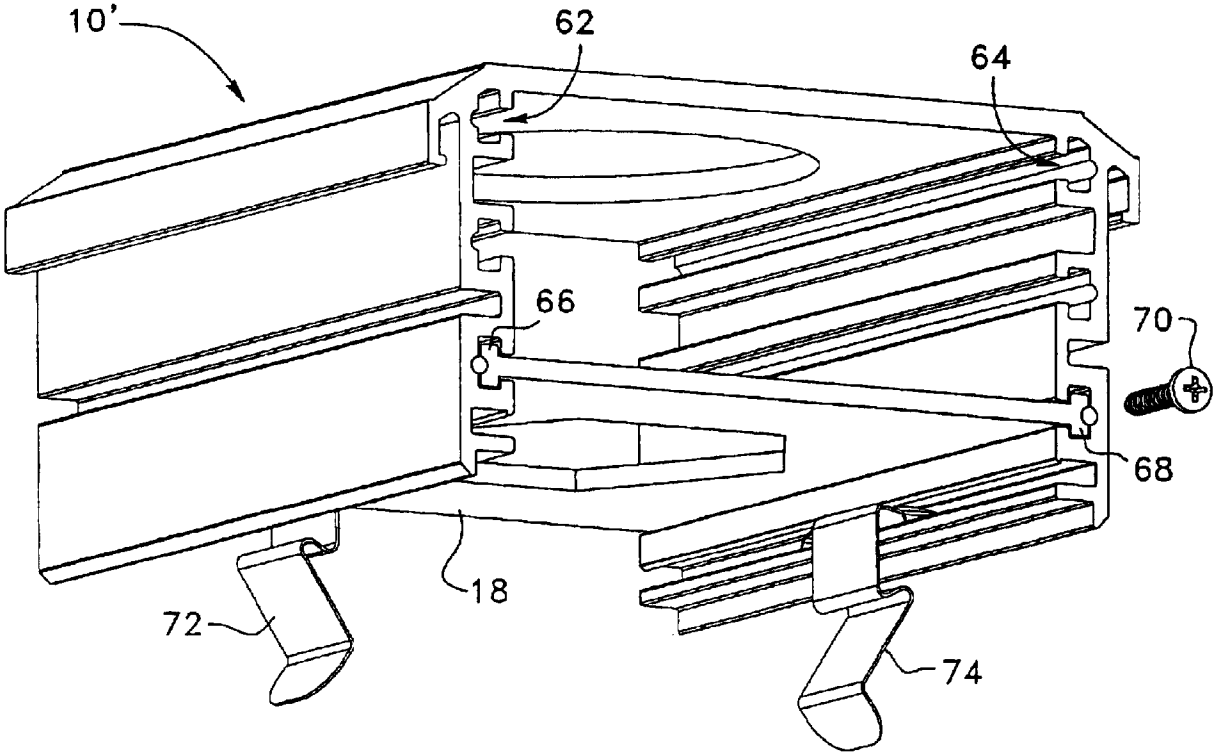
FIG. 6A is a perspective view of an individual tool support module according to the present invention.

Referring to FIGS. 6A and 6B, each module 10' may be provided with a plate locking arrangement for locking the lower plate 18 in selected ones of the slots 62, 64 of the tracks 12, 14. The plate locking arrangement may be formed of a locking screw 70 drivable between one of the track engaging sides 66, 68 of the lower plate 18 and the respective slot 62, 64 of the track 12, 14. Any other suitable locking arrangement can be used, for example by heat fusing the plate 18 with the tracks 12, 14 in the case where all the pieces are made of plastic, or by deforming the pieces using an appropriate punch.

The modules 10' can be held in place and positioned along the rail members 6, 8 by means of spring elements 72, 74 forming clips attachable respectively in lower slots 62, 64 of the tracks 12, 14 adapted for this purpose. The spring elements 72, 74 provide clipping surfaces projecting below the tracks 12, 14 for releasable locking engagement under the rail members 6, 8.

Referring back to FIG. 2, the end members 2, 4 may have respective side faces 76, 78 provided with outwardly projecting mounting tabs 80, 82 and bottom faces 84 through which mounting slots 88 extend (the bottom face and the mounting slot in the right end member 2 are hidden in the Figures), for installing the tool holder assembly in different applications.

While embodiments of this invention have been illustrated in the accompanying drawings and described above, it will be evident to those skilled in the art that changes and modifications may be made therein without departing from the essence of this invention. For example, the tracks 12, 14 may be provided with bearing elements (not shown) projecting from their inner sides instead of slots for bearing the lower plate 18. The rail members 6, 8 may be non-parallel and non-rectilinear so as to provide various spacing distances between them. The holes 20, 22 in a same plate 16, 18 may have different sizes. The rail members 6, 8 may extend down to the base level of the tool holder assembly to provide additional or alternative bottom resting surfaces like or in replacement to those provided by the bottom faces 84 of the end members 2, 4 depending on whichever elements are the lowest. The rail members 6, 8 and the tool support arrangement 12 may be designed so that the tool support arrangement 12 stands in a tilted position when mounted onto the rail members 6, 8, if desired. This can be done with rail members having respective upper edges extending at different heights provided that the tool support arrangement 12 is adapted to such a configuration.

What is claimed is:

1. A tool holder assembly, comprising:

a tool support arrangement having two opposite tracks spaced from each other, and upper and lower plates extending one above the other at different heights between the tracks, at least one of the plates being removably mounted between the tracks, the plates having substantially aligned holes for bi-level tool support; and stand means for holding the tool support arrangement up and providing space under the lower plate thereof, wherein the stand means comprises:

two opposite end members spaced from each other;

two opposite rail members extending between the end members and spaced from each other; and means for mounting the tool support arrangement between the rail members.

2. The tool holder assembly according to claim 1, wherein the means for mounting comprises opposite wings projecting outwards from respective sides of the tool support arrangement, and arranged to rest against upper edges of the rail members when the tool support arrangement is mounted between the rail members.

3. The tool holder assembly according to claim 2, wherein the wings have downward slots into which the upper edges of the rail members respectively engage.

4. The tool holder assembly according to claim 1, wherein the rail members have opposite strengthening flanges innerly projecting toward each other under the tracks when the tool support arrangement is mounted between the rail members.

5. The tool holder assembly according to claim 1, wherein the end members are provided with respective handle members.

6. The tool holder assembly according to claim 5, wherein the handle members respectively fit in the end members and comprise finger gripping surfaces extending behind outer side openings in the end members.

7. The tool bolder assembly according to claim 6, wherein the end members comprise clipping arrangements for clipping of the handle members in the end members.

8. The tool holder assembly according to claim 6, wherein the end members comprise upper folds into which respective upper ends of the handle members engage, and lower bearing surfaces provided with upwardly projecting flexible tabs for clipping of respective lower ends of the handle members in the end members.

9. The tool holder assembly according to claim 8, wherein the rail members have lower opposite flanges innerly projecting toward each other and over which the tracks of the tool support arrangement extend when the tool support arrangement is mounted between the rail members, the lower bearing surfaces being provided by the flanges of the rail members and the flexible tabs being formed in the flanges of the rail members.

10. The tool holder assembly according to claim 8, wherein the lower ends of the handle members have flexible upwardly curved leading edges followed by notches in which the flexible tabs engage.

11. The tool holder assembly according to claim 6, wherein the finger gripping surfaces have rounded shapes.

12. The tool holder assembly according to claim 1, further comprising a track locking means for interlocking the tracks with the rail members when the tool support arrangement is mounted between the rail members.

13. The tool holder assembly according to claim 12, wherein the track locking means comprise locking tabs projecting from one of inner surfaces of the rail members and outer surfaces of the tracks and removably engaging in side channels extending in the other one of the inner surfaces of the rail members and the outer surfaces of the tracks.

14. The tool holder assembly according to claim 1, wherein the end members and the rail members are joined together and form a unitary frame.

15. The tool holder assembly according to claim 1, wherein the upper plate and the tracks are joined together and form a unitary body.

16. The tool holder assembly according to claim 15, wherein the tracks respectively have series of aligned slots at different heights for slidably receiving opposite track engaging sides of the lower plate.

17. The tool holder assembly according to claim 16, wherein the tool support arrangement comprises a plate locking means for locking the lower plate in selected ones of the slots of the tracks.

18. The tool holder assembly according to claim 17, wherein the plate locking means comprises a locking screw drivable between one of the track engaging sides of the lower plate and a respective one of the selected ones of the slots of the tracks.

19. The tool holder assembly according to claim 1, wherein the tool support arrangement has a length corresponding to a spacing between the end members.

20. The tool holder assembly according to claim 1, wherein the holes in the upper plate have a circular shape and the holes in the lower plate have a polygonal or irregular shape.

21. The tool holder assembly according to claim 1, wherein the holes in the upper plate have a greater size than the holes in the lower plate.

22. The tool holder assembly according to claim 1, wherein the plates are made of plastic.

23. The tool holder assembly according to claim 1, wherein the tool support arrangement is divided into replaceable modules having a length substantially smaller than a spacing between the end members.

24. The tool holder assembly according to claim 23, wherein the modules comprise clips attachable respectively to the tracks and providing clipping surfaces projecting below the tracks for releasable locking engagement under the rail members.

25. The tool holder assembly according to claim 1, wherein the end members have respective side faces provided with outwardly projecting mounting tabs.

26. The tool holder assembly according to claim 1, wherein the end members have respective bottom faces through which mounting slots extend.

* * * * *